US005207275A

United States Patent [19]

Strattan et al.

[11] Patent Number: 5,207,275

[45] Date of Patent: May 4, 1993

[54] ANNULUS SAFETY VALVE

[76] Inventors: Scott C. Strattan, 3805 E. 33rd St., Tulsa, Okla. 74135; Thomas M. Deaton, 4328 E. 66th St., #Q, Tulsa, Okla. 74136

[21] Appl. No.: 573,528

[22] Filed: Aug. 27, 1990

[51] Int. Cl.[5] ..... E21B 34/10

[52] U.S. Cl. ..... 166/386; 166/129; 166/321

[58] Field of Search ..... 166/129, 183, 319, 321, 166/324, 332, 373-375, 386, 387

[56] References Cited

U.S. PATENT DOCUMENTS

| | | | |
|---|---|---|---|
| 3,186,483 | 6/1965 | Schwab | 166/129 |
| 4,018,276 | 4/1977 | Bode | 166/129 |
| 4,049,052 | 9/1977 | Arendt | 166/183 |
| 4,460,040 | 7/1984 | Bowyer | 166/129 |
| 4,576,235 | 3/1986 | Slaughter et al. | 166/321 |
| 4,589,482 | 5/1986 | Bayh, III | 166/321 |
| 4,869,318 | 9/1989 | Kellett | 166/321 |

*Primary Examiner*—William P. Neuder

[57] ABSTRACT

The present invention relates to a subterranean well annulus pressure safety valve. In one embodiment, the valve is full opening to permit complete access therethrough of wireline and other remedial tools, and contains the annulus safety valve members completely offset from the central housing. The invention also relates to an annulus safety valve wherein a series of valve elements are placed exterior of a central housing and may be staged to open in series upon incremental increase of pressure thereacross. The annulus safety valve also provides pressure equalization means to equalize pressure across the valve cluster prior to opening of the cluster. The annulus safety valve also has selectively disengagable sealing plug means therein which may be removed while the valve is in the well to increase total fluid flow area through the valve components of the apparatus. A method of controlling an annular area interior of casing within a well using the annulus safety valve also is disclosed.

36 Claims, 3 Drawing Sheets

ANNULUS SAFETY VALVE

BACKGROUND OF THE INVENTION

1. FIELD OF THE INVENTION

The invention relates to an annulus safety valve for use in a subterranean oil and/or gas well and to a method of controlling pressure within an annular area using the safety valve.

2. BRIEF DESCRIPTION OF THE PRIOR ART

Subsequent to the drilling of a subterranean oil and/or gas well, it is completed for the production of fluid hydrocarbons therein by introducing into the well, on a production or workstring, a well packer through which is secured the production or workstring extending to the top of the well. The well packer will be sealingly engaged with the interior of the casing in the well and somewhat above a production zone through which the produced hydrocarbons initially flow interior of the casing, thence through the interior of the packer and production or workstring to the top of the well. Sometimes the packer is included as an integral component of a more complex tool, such as a tubing hanger or the like. Such tools may be run and set in the well together with other tools on the production or workstring in one trip of tubing within the well, or may be run and set separately.

It often occurs in a well that a plurality of zones are intended to be produced either concurrently or selectively. It also occurs that the well "annulus", i.e., that area in the well defined from the inner diameter of the well casing to the exterior diameter of the production and/or workstring, is utilized to either produce fluid hydrocarbons from another production zone either above or below the first zone, as described above, or for purposes of injecting treatment fluids from the top of the well to a particular zone.

Just as safety valves must be provided to selectively sealingly block the interior of the production or workstring so that flow of fluid hydrocarbons from the production zone to the top of the well may be shut off at such safety valve to prevent a "blow out" in the event of an uncontrollable situation, such as a fire, or the like, so the well "annulus" must likewise be controlled if it is exposed to a second production zone or is to be used for injection of fluid for one reason or another from the top of the well to a given production zone within the well.

While annulus safety valves have been utilized in the art, none are "full opening", i.e., the internal diameter of such safety valve components for the annulus is not substantially equal to the internal diameter of the production or workstring, such that tools carried on remedial coiled tubing, wire or electric line, may safely and completely pass therethrough without any interference to longitudinal and/or rotational movement.

As set forth above, the purpose of such annulus safety valves herebefore utilized has been to control well pressure below such valves from communicating the tubing/casing annulus across such valves. It would be desirable to provide control of the annulus, yet permit selective injection of chemical inhibitor, kill fluid, and the like within the tubing casing annular area from above the annulus safety valve to the area therebelow and within the interior of the casing on a selective volumetric basis.

Furthermore, it would be desirable to permit increased fluid flow across such annulus safety valve, selectively, merely by increase of fluid pressure within the tubing casing annulus above the annulus safety valve by permitting plug means which may be shearingly removed from sealing engagement within the valve to permit increase in fluid flow therethrough, such plug means also being replaceable by additional valve head and seat members of the same design and operation as other valve head and seat members forming the annulus safety valve.

The present invention addresses the above-identified problems and provides a unique annulus safety valve as described below and in the drawings incorporated herein.

SUMMARY OF THE INVENTION

The present invention provides a subterranean well annulus safety valve for control of fluid flow between outer and inner tubular conduits concentrically disposed within the well, said conduits extending from a first end of the safety valve to a point in the well.

The annulus safety valve comprises a cylindrical central housing securable to the inner of said tubular conduits. A fluid flow passageway is defined through the central housing and is in fluid flow communication with the interior of the inner of the tubular conduits.

In a preferred embodiment, the internal diameter of the inner tubular conduit and the internal diameter of the central housing are substantially equal.

A ported second housing circumferentially extends around the exterior of and is carried by the central housing, with the second housing being in fluid flow communication at one end thereof with fluid between the outer and inner tubular conduits within the well.

Control valve means include valve head and seat members which are disposed in the second housing with the head and seat members being in normally closed position to prevent fluid between the outer and inner tubular conduits from flowing through the central valve means, with the head and seat members being movable relative to one another to permit fluid flow through the control valve means.

The apparatus also includes, in one embodiment, a ported housing with a series of ports defined therethrough and circumferentially extending around the housing and at least one of the ports receiving the valve head and seat means.

In the preferred embodiment, the valve seat is on the housing and the valve head is selectively sealingly engagable therewith.

The apparatus also includes pressure equalizing means within the ported second housing which is selectively movable while the valve head and seat means are in closed position from a first closed and sealed position to a second open pressure equalizing position to thereby equalize pressure across the valve head and seat means and the exterior of the central housing.

In the preferred embodiment, there is provided a series of valve head and seat members, with the valve head and seat members including members thereon to initiate movement of each of the valve head and seat members in sequence from a normally closed position to permit fluid flow therethrough in response, preferably, to varied application of pressure thereacross as well as when well pressure upstream of the members is greater than pressure downstream of such members.

As used herein, both in the claims and in the specification, the term "normally closed" means the position at which the valve head and seat members are located when there is no pressure differential thereacross.

DESCRIPTION OF THE PREFERRED EMBODIMENTS

Figure 1:
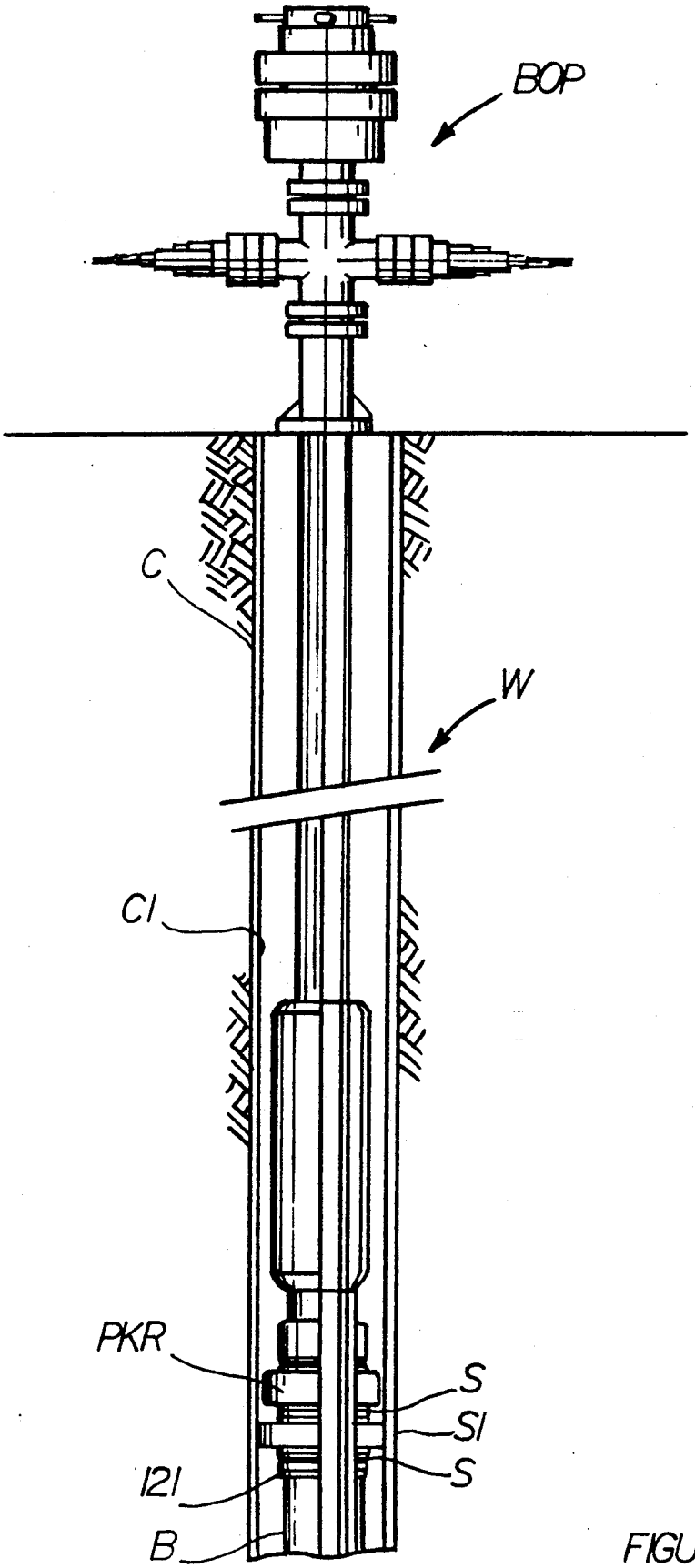
FIG. 1 is a longitudinal sectional schematic illustration of a well incorporating the annulus safety valve system of the present invention, in schematic view.

Now with reference first to FIG. 1, there is schematically shown a subterranean oil or gas well W which has affixed at the uppermost end thereof a conventional preventor stack BOP.

The well W is encased with a string of casing C with a packer PKR in gripping and sealing engagement with the internal diameter C1 of the casing C by means of slips S and elastomeric seal S-1. The packer PKR is carried into the well on an inner tubular conduit A which is secured to the packer PKR by means of threads 122. Also extending through the interior bore of the packer at end 121 is an outer conduit B, the interrelationship with other components being hereinafter described in detail.

Figure 2:
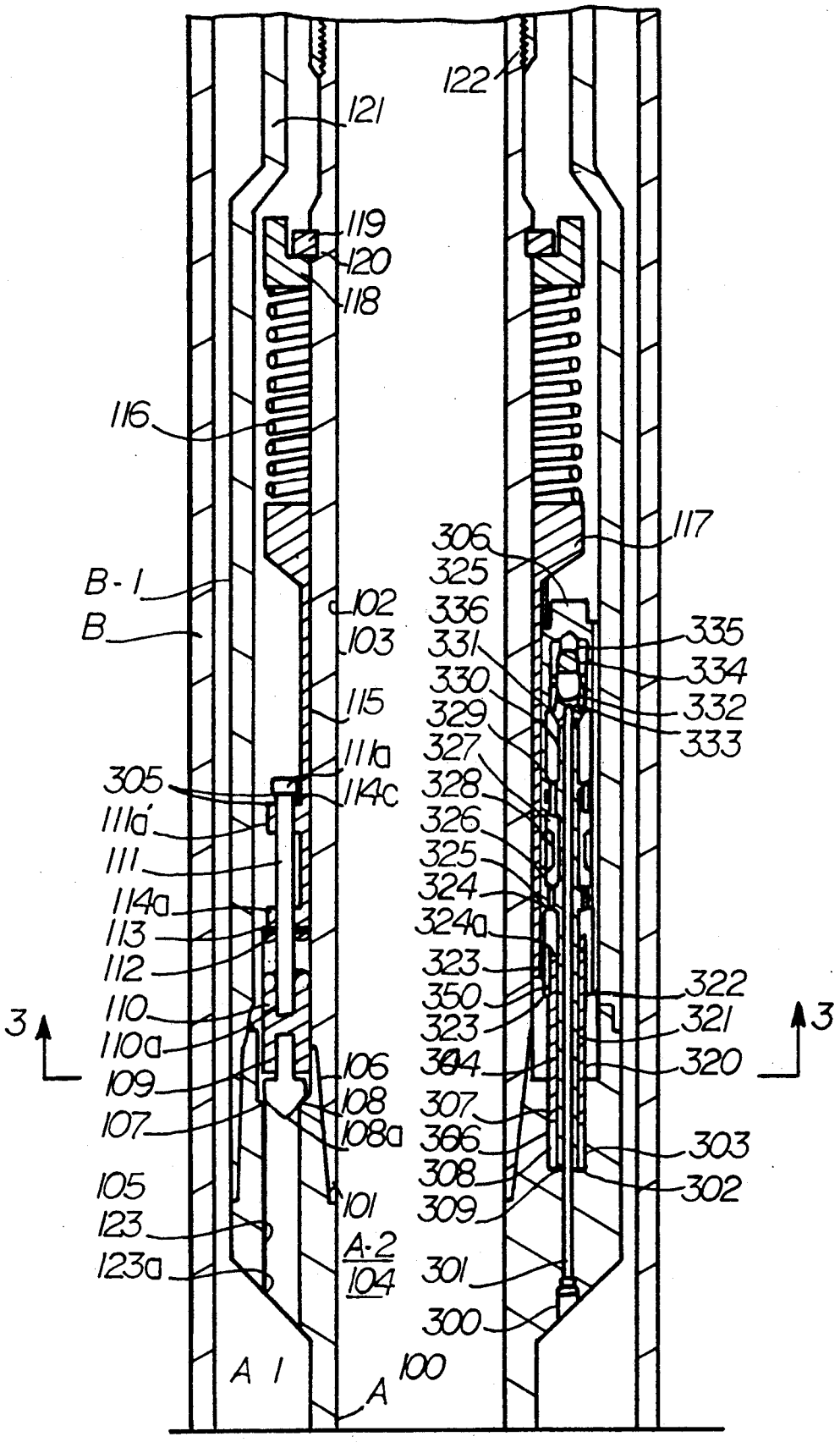
FIG. 2 together constitute a longitudinally extending half sectional illustration of the annulus safety valve of the present invention in normally closed position.

Now, with particular reference to FIG. 2, the apparatus 100 is shown in detail and is secured at threads 101 to the lowermost end of the inner tubular conduit A. The inner tubular conduit A has an inner diameter A1 which is substantially the same as the inner diameter 103 of an inner conduit 102 portion of the apparatus 100 which is secured by means of the threads 101 to the inner tubular conduit A.

The interior A2 of the inner conduit A is always in fluid communication with a companion fluid flow passageway 104 extending through the interior of the conduit 102 of the apparatus 100.

Around the lower end of the inner conduit 102 and secured thereto by threads 101 and defining the lowermost end of the tubular conduit A, is a circumferentially extending ported second housing 105 having a passageway 123 defined longitudinally therein with a first open entry way area 123*a* defined between the exterior of the inner tubular conduit A and the internal diameter C1 of the casing C.

The end opposite the opening 123*a* of the ported second housing 105 defines a circumferentially subscribed angularly beveled metallic valve seat 107 for companion receipt of a valve head end 108*a* of a valve head member 108. These valve head and seat members are normally biased to the closed position, but are selectively openable upon either application of pressure through the opening 123*a* into the passage 123 from the top of the well, or, more preferably and conventionally, by means of application of hydraulic or pneumatic control fluid pressure through the control fluid passageway 301 extending to a control conduit (not shown), to the top of the well, as described hereafter. The valve head 108 and the valve seat 107 members together constitute the control valve means 106.

The valve head member 108 is secured at threads 109 to a spring retainer 110 which, in turn, is secured at threads 110*a* to a valve mandrel 111. The valve mandrel 111 is secured at threads 110*a* to the spring retainer 110. The valve mandrel 111 is positioned through a lower actuating sleeve 114*a* and an upper actuating sleeve 114*c* extending from a control mandrel 115. The sleeve 114*a* has its lower end in abutting relation with a washer 113 which receives one end of a biasing means defined as a control spring 112 extending to the upper end of the spring retainer 110.

The valve mandrel 111 also has an enlarged upper head member 111*a* having a lower facing shoulder 111*a*' for selective abutting contact and engagement with a companion upwardly facing shoulder 114*c* on the upper sleeve 114*b*. The expanded distance between the shoulder 114*c* and the shoulder 111*a*' defines the equalizing travel 305 required to equalize fluid across the apparatus 100 prior to the control mandrel 115 shifting the control valve means 106 to the open position subsequent to manipulation to the open position of the equalizing valve head 303 and the equalizing valve seat member 302.

Figure 3:
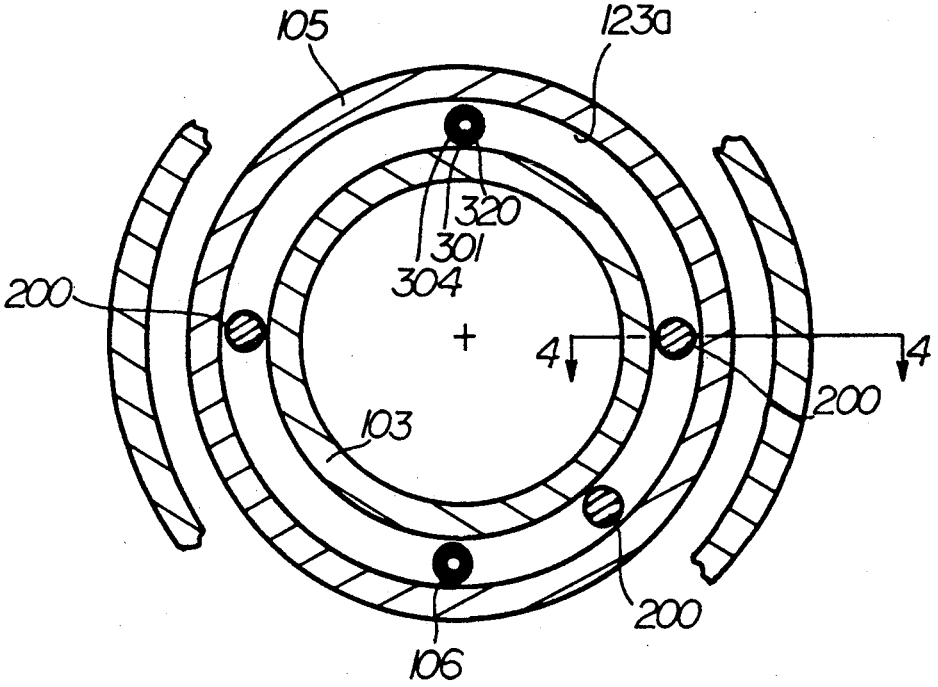
FIG. 3 is a sectional view taken along line 3—3 of FIG. 2 illustrating the positioning of the valve head and seat members relative to the outer housing.

Now referring to FIG. 3, it will be appreciated that there is illustrated entry way 123*a* circumferentially defined through the ported second housing 105 with a plurality of control valve means 106 disposed therethrough with three of the control valve means 106 being plugged by plug elements 200. Approximately 180° from the first control valve means 106 is the equalizing valve means, including control fluid passageway 301, valve head stem 304, and cylinder member 320 as further described hereafter.

Figure 4:
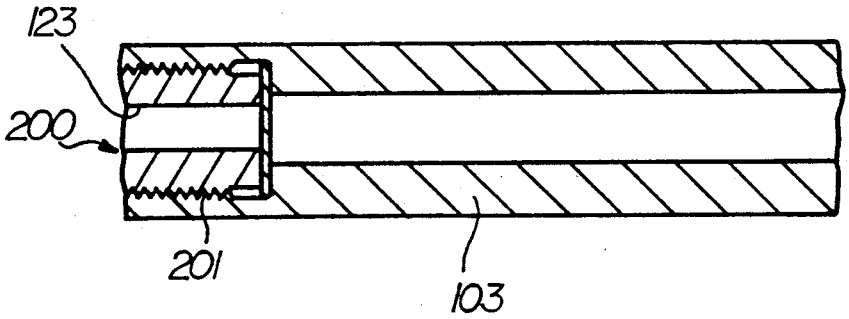
FIG. 4 is a view taken along line 4—4 of FIG. 3 showing the plug means of the present invention being substituted for a valve head and seat member combination.

As shown in FIG. 4, which is, as stated in the description of the drawings above, a partial longitudinal section view taken along line 4—4 of FIG. 3 showing the plug means 200 of the present invention being substituted for a valve head 108 and valve seat 107 combination, one or more of the passageways 123 may contain a plug element 200 which is secured to the ported second housing 105 by means of a shearing 201, shear pin, or the like, thus the plug means 200 replacing one or more of the control valve means 106.

The control mandrel 115 has at its upper end an enlarged top spring seat 117 which receives the lowermost end of a power spring 116. The power spring 116 is housed radially around the exterior of the inner conduit 102 and has its uppermost end arrestingly secured on the lower face of a bottom spring seat 118 secured to the inner conduit 102 by means of a lock nut 119.

The power spring 116 is, in effect, a biasing means and may be provided in the form of Bellville washers, a collapsible spring element, or the like. At any rate, the function of the biasing or power spring element 116 is to transmit a closing force from the inner conduit 102 through the control mandrel 115 to the control valve means 106, such that the valve head 108 is in sealing engagement with its companion valve seat 107 and the valve head end 108*a* extends, slightly, within the passageway 123. The force defined through the biasing means or power spring 116 may, of course, be selectively varied, such that the control valve means 106 may be manipulated from the normally closed position to the open position to permit fluid flow through the passageway 123 at varied pressures.

Moreover, the biasing force through the power string 116, together with the force defined through the control spring 112 may be selectively varied with respect to two or more control valve means 106, such that the various valve heads 106 within the ported second housing 105 may be serially manipulated to open position.

Alternatively, or concurrently, the size and configuration of the valve head 108 may be altered or varied, slightly, such that each of the control valve means 106 are manipulated to open position upon various changes in fluid pressure encountered thereacross.

The annulus safety valve apparatus 100 of the present invention may be manipulated from the normally closed position, shown in the drawings, to the open position to permit fluid flow through the passageway 123 between the inner conduit 102 and the external or outer conduit B by means of application of hydraulic control pressure from the top of the well through the control conduit (not shown), which communicates into the control fluid passageway 301 and which is secured at threads 300 to the ported second housing 105.

Additionally, if it is desired to pump fluid in the tubing/casing annulus from the top of the well through the apparatus 100, thence through the packer in the annular area defined between the inner conduit 102 and the outer conduit B to the area of the well below the packer PKR, the control valve means 106 can be provided such that the bias towards the closed position defined as the power through the power string 116 in combination with the control spring 112 can be varied such that any anticipated pressure through such annular area from the top of the well will open such control valve means 106 for injection purposes. However, it will be appreciated that by manipulating such control valve means 106 in such fashion, such control valve means 106 will not be able to be first manipulated to pressure equalizing condition and that such manipulation of the control valve means 106 should preferably be done only when pressure across the control valve means 106 is substantially equal and that there is no effective differential pressure thereacross which could adversely affect the sealing integrity of the valve members 108, 108*a*.

For equalization purposes, an equalizing valve seat member 302 receives an equalizing valve head 303 with the valve head 303 defining the uppermost end of the valve head stem 304.

The equalizing valve head 303 is moved away from the equalizing valve seat member 302 to equalizing position which is defined as the equalizing travel 305 between the shoulder 114*c* and the shoulder 111*a*' between the valve mandrel 111 and the control mandrel 115. Until such equalizing travel 305 is completed, the control valve means 106 will not be moved from the normally closed position, thus enabling the equalizing valve members 302, 303 to be manipulated from fully closed position to fully open position prior to actuation of the control valve means 106, thus assuring that there is no differential pressure across the control valve means 106.

Now with reference to an actuating assembly as shown in FIG. 2, a sealing assembly 306, 307 provides a metal to metal seal to control fluid line. A piston collar 308 retains the seal assembly 306, 307 relative to the valve head stem 304. A piston member 309 is stationarily attached to the top of the valve head stem 304 and defines a cylinder stop which is threaded into a cylinder member 320. A metal to metal seal assembly is defined between the uppermost end 321 of the member 320 and the lowermost end 322 of a cylindrical stop member which, in turn, is secured at threads 323 to a cylindrical central housing member 324 which, in turn, is secured at threads 325 to a lower closed end member 326.

The cylindrical member 324 is secured relative to the control mandrel 115 by means of a cylinder stop 350 such that the cylinder is the dynamic moving component and the valve stem 304 is the secured, static nonmoving component. Thus, members 322, 350 and 326 form a cylindrical configuration.

The stop 322 has at one end thereof a metal to metal seal defined at the uppermost end 323 and the upper end 324*a* protruding around the valve head stem 304 which is a portion of a cylindrical seal element around the valve head stem 304.

A spring element 325 energizes the sealing member 324*a*, with piston bearing 326 centering the piston assembly with seals interior of the cylinder. A dynamic wiper seal 327 is provided above a support feral 328 with the seal 327 being nonelastomeric for sealing of control of fluid. The support feral 328 is a metal to metal backup for the wiper seal element 327 and is functional for wiping contaminants relative to the solid cylindrical elements during stroking of the piston assembly.

A second piston bearing 329 centers the piston assembly within the cylinder.

Sleeve 330 supports the lower piston bearing 329 and the dynamic wiper seal 327 and is threadably secured to the piston housing 350. A locknut 331 is provided securing the sleeve 330 to the piston 304.

A plug stop seat 332 is provided which is a metal to metal seal on the bottom of the piston 304 at seat 333, with an expander shem 334 being provided for translation of the spring force in a biasing spring 335 to the plug stop seat 332. A cylinder plug end 326 closes the end of the cylinder with a metal to metal seal at point 336.

OPERATION

The apparatus 100 will be run into the well W and positioned as shown in FIG. 1. When it is desired to open the control valve means 106, the apparatus 100 is first equalized by moving the equalizing valve head 303 from the equalizing valve seat member 302. This is effected by first applying an increase of pressure within the control fluid conduit through the passageway 301 to pressurize the interior of the cylinder below the lower dynamic wiper seal 327 to extend the cylinder away from the ported second housing 105. The cylinder 304 contacts the cylinder sleeve 324 which moves the cylinder sleeve 324 downwardly against the power spring 116 to compress such power spring 116. Now the shoulder 114*c* of the control mandrel 115 will move toward the shoulder 111*a*' the distance of travel being the equalizing travel distance 305. As the shoulders 114*c* and head 111*a*' come together, the valve head 303 is stroked away from the seat member 302, thus permitting control fluid 301 to be equalized with pressure below the ported second housing 105. When the equalizing travel 305 is completed by continued application of fluid pressure through the control fluid passageway 301 from the control fluid line, the power spring 116 continues to be further compressed and one or more of the control valve means 106 are manipulated to open position with the valve head 108 being moved from the valve seat 107, respectively, depending upon the additional power defined through the control spring 116. Likewise, the control valve means 106 are manipulated to closed position by reduction in control fluid pressure through the control fluid conduit and the control fluid passageway 301, and the valve head means 106 are manipulated to closed position as the power in the spring 116 overcomes the fluid pressure in the control fluid passageway 301.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A subterranean well annular safety valve for control of fluid flow between outer and inner tubular conduits concentrically disposed within said well, said conduits extending from the first end of said safety valve to a point in said well, said annular safety valve comprising:

(1) a cylindrical central housing securable to the inner of said tubular conduits;

(2) a fluid flow passageway defined through said central housing and in fluid flow communication with the interior of the inner of said tubular conduits, the internal diameter of said inner tubular conduit and the internal diameter of said central housing being substantially equal;

(3) a ported second housing circumferentially extending around the exterior of and carried by said central housing, said second housing being in fluid flow communication at one end thereof with fluid between said outer and inner tubular conduits within said well; and (4) control valve means including valve head and seat members disposed in said second housing, said head and seat members being in normally closed position to prevent fluid between said outer and inner tubular conduits from flowing through said central valve means, said head and seat members being movable relative to one another to permit fluid flow through said control means (5) pressure equalization valve means, including a valve head and a valve seat which mate in a closed position and separate in an open position, for equalizing pressure between said outer and inner tubular conduits;

(6) control valve actuator means for moving said control valve means between said normally closed position and an open position;

(7) pressure equalization actuator means for moving said pressure equalization valve means between a normally closed position and an open position;

(8) bias means for mechanically biasing said control valve means and said pressure equalization valve means into normally closed positions; and (9) wherein said control valve actuator means and said pressure equalization actuator means are mechanically linked solely through said bias means.

2. The apparatus of claim 1, said ported housing including a series of ports defined therethrough and circumferentially extending around said housing, and at least said one of said ports receiving said valve head and seat means.

3. The apparatus of claim 2 wherein said valve seat is on said ported second housing and said valve head is selectively sealingly engagable therewith.

4. The apparatus of claim 2 wherein any of said ports not receiving said valve head and seat means include removable plug means to prevent any fluid flow therethrough while said safety valve is in an operating position within said well.

5. The apparatus of claim 2 wherein any of said ports not receiving said valve head and seat means include removable plug means to prevent any fluid flow through the respective port.

6. The apparatus of claim 4 or claim 5 wherein said removable plug means comprise a plug element selectively removable from within said port to thereafter permit fluid flow through said port, said element being removable by application of pressure at least equal to a predeterminable amount across said element.

7. The apparatus of claim 1 further comprising at least one biasing means for urging one of said valve head and seat means toward the other of said valve head and seat means.

8. The apparatus of claim 1 further comprising pressure equalizing means within said ported second housing selectively movable while said valve head and seat means are in closed position, from a first closed and sealed position to a second open, pressure equalizing position, to thereby equalize pressure across said valve head and seat means and exterior of said central housing.

9. The apparatus of claim 7 wherein said biasing means is exterior of said central housing.

10. The apparatus of claim 7 wherein said biasing means is exteriorly carried around said central housing.

11. The apparatus of claim 1 wherein there is further provided a plurality of said valve head and seat members, one of said valve head and seat members being movable from normally closed position to permit fluid flow therethrough while the other of the valve head and seat members are in normal closed position.

12. The apparatus of claim 1 wherein there is provided a series of valve head and seat members, said valve head and seat members including means thereon to initiate movement of each of said valve head and seat members in sequence from normally closed position to permit fluid flow therethrough.

13. The apparatus of claim 1 wherein there is provided a series of valve head and seat members, said valve head and seat members including means thereon to initiate movement of each of said valve head and seat members in sequence from normally closed position to permit fluid flow therethrough in response to varied application of pressure thereacross.

14. A subterranean well annular safety valve for control of fluid flow between outer and inner tubular conduits concentrically disposed within said well, said conduits extending from the first end of said safety valve to a point in said well, wherein a control conduit is disposed in said subterranean well and coupled to said annular safety valve for supplying control fluid, said annular safety valve comprising:

(1) a cylindrical central housing securable to the inner of said tubular conduits;

(2) a fluid flow passageway defined through said central housing and in fluid flow communication with the interior of the inner of said tubular conduits;

(3) a ported second housing circumferentially extending around the exterior of and carried by said central housing, said second housing being in fluid flow communication at one end thereof with fluid between said outer and inner tubular conduits within said well; and (4) control valve means including valve head and seat members disposed in said second housing, said head and seat members being in normally closed position to prevent fluid between said outer and inner tubular conduits from flowing through said central valve means, said head and seat members being movable relative to one another to permit fluid flow through said control valve means.

(5) pressure equalization valve means, including a valve head and a valve seat which mate in a closed position and separate in an open position, for equalizing pressure between said outer and inner tubular conduits;

(6) control valve actuator means for moving said control valve means between said normally closed position and an open position;

(7) pressure equalization actuator means for moving said pressure equalization valve means between a normally closed position and an open position;

(8) bias means for mechanically biasing said control valve means and said pressure equalization valve means into normally closed positions; and (9) wherein said control valve actuator means and said pressure equalization actuator means are mechanically linked solely through said bias means;

(10) wherein said control conduit is coupled to said pressure equalization valve means for supplying control fluid to said pressure equalization actuator means; and

(11) wherein said annular safety valve is operable in a plurality of operating modes, including:

(a) an equalization mode, wherein said control conduit supplies control fluid to said pressure equalization valve means to urge said pressure equalization actuator means to simultaneously open said pressure equalization valve means and act upon said bias means, while maintaining said control valve means in said normally closed position; and (b) a open valve mode of operation, wherein application of control fluid acts on said control valve actuation means through said bias means to allow said control valve means to move to an open position.

15. The apparatus of claim 14, said ported housing including a series of ports defined therethrough and circumferentially extending around said housing, and at least said one of said ports receiving said valve head and seat means.

16. The apparatus of claim 15 wherein said valve seat is on said ported second housing and said valve head is selectively sealingly engagable therewith.

17. The apparatus of claim 15 wherein any of said ports not receiving said valve head and seat means include removable plug means to prevent any fluid flow therethrough while said safety valve is in an operating position within said well.

18. The apparatus of claim 15 wherein any of said ports not receiving said valve head and seat means include removable plug means to prevent any fluid flow through the respective port.

19. The apparatus of claim 17 or claim 18 wherein said removable plug means comprise a plug element selectively removable from within said port to thereafter permit fluid flow through said port, said element being removable by application of pressure at least equal to a predeterminable amount across said element.

20. The apparatus of claim 14 further comprising at least one biasing means for urging one of said valve head and seat means toward the other of said valve head and seat means.

21. The apparatus of claim 14 further comprising pressure equalizing means within said ported second housing selectively movable while said valve head and seat means are in closed position, from a first closed and sealed position to a second open, pressure equalizing position, to thereby equalize pressure across said valve head and seat means and exterior of said central housing.

22. The apparatus of claim 20 wherein said biasing means is exterior of said central housing.

23. The apparatus of claim 20 wherein said biasing means is exteriorly carried around said central housing.

24. The apparatus of claim 1 or claim 14 wherein one end of the outer tubular conduit is sealingly engagable relative to the interior of a casing conduit disposed within said well.

25. The apparatus of claim 24 wherein said sealing engagement is provided by means of an auxiliary well tool carried by one of said outer and inner tubular conduits and comprising anchoring and sealing members movable from a first contracted running position to a second radially expanded set position in said well whereby said sealing member sealingly engages circumferentially around a point on said casing conduit.

26. The method of controlling fluid flow between outer and inner tubular conduits concentrically disposed within a subterranean well, said conduits extending from a first end of an annular safety valve to a point in said well, comprising the steps of:

(a) assembling at the top of a well onto said inner tubular conduit, an annular safety valve, comprising:

(1) a cylindrical central housing securable to the inner of said tubular conduits;

(2) a fluid flow passageway defined through said central housing and in fluid flow communication with the interior of the inner of said tubular conduits, the internal diameter of said inner tubular conduit and the internal diameter of said central housing being substantially equal;

(3) a ported second housing circumferentially extending around the exterior of and carried by said central housing, said second housing being in fluid flow communication at one end thereof with fluid between said outer and inner tubular conduits within said well;

(4) control valve means including valve head and seat members disposed in said second housing, said head and seat members being in normally closed position to prevent fluid between said outer and inner tubular conduits from flowing through said central valve means, said head and seat members being movable relative to one another to permit fluid flow through said control valve means; and (5) pressure equalization valve means, including a valve head and a valve seat which mate in a closed position and separate in an open position, for equalizing pressure between said outer and inner tubular conduits;

(6) control valve actuator means for moving said control valve means between said normally closed position and an open position;

(7) pressure equalization actuator means for moving said pressure equalization valve means between a normally closed position and an open position;

(8) bias means for mechanically biasing said control valve means and said pressure equalization valve means into normally closed positions; and (9) wherein said control valve actuator means and said pressure equalization actuator means are mechanically linked solely through said bias means;

(b) running said annular safety valve into position within said well; and (c) energizing said valve head and seat members to move said members from the normally closed position to permit fluid flow through said control valve means.

27. The method of controlling fluid flow between outer and inner tubular conduits concentrically disposed within a subterranean well, said conduits extending from a first end of an annular safety valve to a point in said well, comprising the steps of:

(a) assembling at the top of a well onto said inner tubular conduit, an annular safety valve comprising:

(1) a cylindrical central housing securable to the inner of said tubular conduits;

(2) a fluid flow passageway defined through said central housing and in fluid flow communication with the interior of the inner of said tubular conduits, the internal diameter of said inner tubular conduit and the internal diameter of said central housing being substantially equal;

(3) a ported second housing circumferentially extending around the exterior of and carried by said central housing, said second housing being in fluid flow communication at one end thereof with fluid between said outer and inner tubular conduits within said well;

(4) control valve means including valve head and seat members disposed in said second housing, said head and seat members being in normally closed position to prevent fluid between said outer and inner tubular conduits from flowing through said central valve means, said head and seat members being movable relative to one another to permit fluid flow through said control valve means;

(5) pressure equalization valve means, including a valve head and a valve seat which mate in a closed position and separate in an open position, for equalizing pressure between said outer and inner tubular conduits;

(6) control valve actuator means for moving said control valve means between said normally closed position and an open position;

(7) pressure equalization actuator means for moving said pressure equalization valve means between a normally closed position and an open position;

(8) bias means for mechanically biasing said control valve means and said pressure equalization valve means into normally closed positions; and (9) wherein said control valve actuator means and said pressure equalization actuator means are mechanically linked solely through said bias means;

(b) running said annular safety valve into said well either tandemly or sequentially with: packing means positionable below said annular safety valve and including a flow passageway therethrough extending to and in fluid communication with the interior of the outer tubular conduit and the exterior of the inner tubular conduit, and further including anchoring and sealing members movable from a first running position to a second expanded position whereby said packing means is anchored in said well and is in sealing engagement with a casing conduit disposed within said well, and, when in said anchored and sealing position, a passageway therethrough being in fluid communication with the interior of the casing below said packing means;

(c) running said tubular conduits into said well;

(d) setting said packing means; and (e) manipulating said control valve means to open position.

28. The method of claim 27, said ported housing including a series of ports defined therethrough and circumferentially extending around said housing, and at least said one of said ports receiving said valve head and seat means.

29. The method of claim 28 wherein said valve seat is on said housing and said valve head is selectively sealingly engagable therewith.

30. The method of claim 28 wherein any of said ports not receiving said valve head and seat means include removable plug means to prevent any fluid flow therethrough while said safety valve is in an operating position within said well.

31. The method of claim 28 wherein any of said ports not receiving said valve head and seat means include removable plug means to prevent any fluid flow through the respective port.

32. The method of claim 30 or claim 31 wherein said removable plug means comprise a plug element selectively removable from within said port to thereafter permit fluid flow through said port, said element being removable by application of pressure at least equal to a predeterminable amount across said element.

33. The method of claim 27 further comprising at least one biasing means for urging one of said valve head and seat means toward the other of said valve head and seat means.

34. The method of claim 27 further comprising pressure equalizing means within said ported second housing selectively movable while said valve head and seat means are in closed position, from a first closed and sealed position to a second open, pressure equalizing position, to thereby equalize pressure across said valve head and seat means and exterior of said central housing.

35. The method of claim 33 wherein said biasing means is exterior of said central housing.

36. The method of claim 33 wherein said biasing means is exteriorly carried around said central housing.

* * * * *